US007007721B2

(12) United States Patent
Bassi et al.

(10) Patent No.: US 7,007,721 B2
(45) Date of Patent: Mar. 7, 2006

(54) SHEDDING DEVICE ON A JACQUARD-TYPE WEAVING MACHINE

(75) Inventors: Dario Bassi, Chaponnay (FR); Damien Bouchet, Chaponnay (FR); Guillaume Boutte, Aveize (FR)

(73) Assignee: Staubli Lyon, Chassieu (FR)

( * ) Notice: Subject to any disclaimer, the term of this patent is extended or adjusted under 35 U.S.C. 154(b) by 215 days.

(21) Appl. No.: 10/481,795

(22) PCT Filed: Jun. 28, 2002

(86) PCT No.: PCT/FR02/02267

§ 371 (c)(1),
(2), (4) Date: Dec. 23, 2003

(87) PCT Pub. No.: WO03/002799

PCT Pub. Date: Jan. 9, 2003

(65) Prior Publication Data

US 2005/0103394 A1 May 19, 2005

(30) Foreign Application Priority Data

Jun. 29, 2001 (FR) ..... 01 08663

(51) Int. Cl.
*D03C 3/00* (2006.01)

(52) U.S. Cl. ..... 139/59; 139/61; 139/62; 139/63; 139/64; 139/65

(58) Field of Classification Search ..... 139/59–65
See application file for complete search history.

(56) References Cited

U.S. PATENT DOCUMENTS

| | | | | |
|---|---|---|---|---|
| 4,627,369 | A * | 12/1986 | Conrad et al. | 112/102.5 |
| 5,140,841 | A * | 8/1992 | Offermann et al. | 66/207 |
| 5,261,464 | A | 11/1993 | Lorenzo et al. | |
| 5,435,353 | A * | 7/1995 | Bourgeaux | 139/59 |
| 5,743,306 | A * | 4/1998 | Stewart et al. | 139/7 A |
| 6,092,564 | A | 7/2000 | Bourgeaux et al. | |
| 6,216,750 | B1 | 4/2001 | Braun et al. | |

FOREIGN PATENT DOCUMENTS

| | | |
|---|---|---|
| DE | 2 794 141 | 12/1999 |
| EP | 0 353 005 | 1/1990 |
| EP | 0 668 381 | 8/1995 |
| EP | 0 750 061 | 12/1996 |
| EP | 0 848 097 | 6/1998 |
| EP | 1 069 218 | 1/2001 |
| JP | 11350285 | 12/1999 |
| WO | WO 00 17431 | 3/2000 |

* cited by examiner

*Primary Examiner*—John J. Calvert
*Assistant Examiner*—Robert Muromoto
(74) *Attorney, Agent, or Firm*—Dowell & Dowell PC

(57) ABSTRACT

The invention relates to a shedding device comprising at least one electric rotary actuator having an output shaft (11) that is designed to rotate a pinion (21) which is engaged with a rack (22), said rack being connected to a control heald (3) of a warp end (4) by means of a load transfer element (24).

21 Claims, 7 Drawing Sheets

SHEDDING DEVICE ON A JACQUARD-TYPE WEAVING MACHINE

The present invention relates to a device for forming the shed in a weaving loom of Jacquard type.

In weave systems of Jacquard type, it is known to drive, in phase opposition, two frames each bearing a multiplicity of griffes or horizontal knives adapted to vertically displace the hooks connected to the harness cords by a pulley or block and tackle mechanism.

It is also known, for example by EP-A-0 933 456, to use a pulley controlled by an electrical rotary actuator for winding a funicular element more or less in order to alternately displace the heddles of a Jacquard loom. This state of the art functions satisfactorily, but involves the use of a large number of electrical actuators insofar as the heddles are controlled individually or in small numbers by each actuator. If a number of heddles are controlled by the same actuator, the relative angle of inclination of the harness cords connected to these heddles must be relatively small in order to limit the efforts of friction, which imposes the positioning of the actuators and may, in certain configurations, lead to a considerable space requirement for the device. A weave system using this type of device is known from EP-A-1 069 218.

It is an object of the invention to propose an alternative solution to those known from the state of the art, which enables a large number of warp yarns to be controlled, in a reduced space requirement and with a number of actuators that may be less than that of known systems, which is advantageous in terms of cost and reliability.

To that end, the invention relates to a device for forming the shed in a weaving loom of Jacquard type, comprising at least one electrical rotary actuator. This device is characterized in that this actuator is adapted to drive in rotation at least one pinion in mesh with a rack connected, by an effort transmission element, to at least one heddle.

Thanks to the invention, the pinion/gear link makes it possible to transform the movement of rotation of the output shaft of the actuator into a movement of oscillations used for displacing a heddle with respect to the picks.

According to a first advantageous aspect of the invention, the actuator is adapted to drive in rotation a plurality of racks distributed along the longitudinal direction of an output shaft of the actuator. This makes it possible to control a relatively large number of heddles thanks to a single actuator, hence a significant saving of space for the equipment of a conventional weaving loom which may include more than 10 000 warp yarns. In that case, the spaced apart relationship of the racks in the direction of the output shaft of the actuator and/or the number of these racks driven by this actuator, may be adjustable, which makes it possible to adapt the geometrical distribution of the heddles and/or their number to the desired weaves. In addition, the drive pinions of the racks may be adapted to slide with reduced clearance in the longitudinal direction of the or each shaft, the shafts and the pinions presenting complementary profiles, splined or equivalent, which allows connection thereof in rotation.

According to another advantageous aspect of the invention, means for synchronising the racks in mesh with the pinions driven with the same actuator comprise an elastic element adapted to limit the stroke of the rack to a position beyond which its toothing would be disconnected from that of the pinion associated therewith, with the result that, by a sufficient rotation of the output shaft of the actuator, the racks are aligned with respect to one another. This elastic element makes it possible to stop the movement of the rack at the level of its top dead centre and/or of its bottom dead centre, by exerting thereon an effort of taking-up of clearance between the toothing of the rack and the toothing of the pinion while, if the pinion tends to push the rack beyond the top dead centre and bottom dead centre position, the toothings in mesh may escape from one another. This makes it possible rapidly and precisely to align the different racks driven by the same actuator. This elastic element may be provided with an end adapted to bear against at least one stop formed on the rack. In that case, the rack may be provided with a longitudinal groove for slidably receiving the second end of the tongue.

According to a first advantageous embodiment of the invention, the effort transmission element may be a semi-rigid rod, this allowing a positive control of the associated heddle or heddles. In that case, this rod may slide in a guide sheath, which makes it possible to distribute the heddles driven by the same output shaft in accordance with the weave pattern to be made, without strict limitation on the angles of inclination of the kinematic control chain of the heddles. The rod is advantageously made of synthetic material based on epoxy carbon.

According to another advantageous embodiment of the invention, the effort transmission element may be a supple funicular element, of harness cord type. This makes it possible to control the lifting of each heddle, a return spring being associated with each heddle to exert thereon a downwardly directed effort.

According to another advantageous aspect of the invention, the device, which comprises electrical rotary actuators arranged in rows and columns above the loom, is characterized in that these actuators are arranged so that their respective output shafts are substantially parallel to one another, preferably substantially parallel to the direction of the weft yarns of the loom, and in that each output shaft is adapted to drive a plurality of pinions each in mesh with a rack kinematically linked to at least one heddle for controlling a warp yarn. This aspect of the invention makes it possible to control a large number of warp yarns in a reduced space and with a number of actuators that may be less than that of the known systems, which is advantageous in terms of cost and reliability. The arrangement of the output shafts of the electrical rotary actuators makes it possible to juxtapose drive pinions in the direction of the geometrical axis of these shafts. A plurality of heddles may thus be efficiently controlled over the width of the loom, with the same actuator, this avoiding multiplying the actuators. The pinions may be positioned along the shafts so that the effort transmission elements present paths which are the least curved or angular possible. In this way, the transmission of effort is more direct.

The following arrangements may, in addition, be provided:

- The actuators are distributed on plates immobilized with respect to the superstructure of the loom and disposed substantially parallel to the warp yarns. In that case, the actuators are advantageously distributed in two groups each supported by a plate, the output shafts of the actuators extending, in essence, in a volume defined between these plates. This construction is particularly compact and makes it posible to implant the shafts of the actuators with high density without the transverse dimensions of the actuators creating a hindrance at that level.
- A plurality of pinions driven by parallel shafts and distinct from the device are integrated, with the corresponding racks, in a sub-assembly extending substantially in a direction perpendicular to these shafts. Such a sub-assembly makes it possible to manipulate at the same time a plurality of couples of pinions and racks, which facilitates the operations of assembly and of maintenance of the device and allows a precise positioning of the elements of the kinematic chain. Such a sub-assembly advantageously comprises pinions and racks whose number corresponds to the number of actuators of a row of actuators. Each sub-assembly may be provided to comprise a common casing provided with openings for passage of the shafts and with housings for receiving the pinions and racks.

A perforated board is immobilized with respect to the superstructure of the loom, in the vicinity of the actuators, while a comber board is arranged in the vicinity of the heddles, the effort transmission elements between the associated racks and heddles each following a path defined by openings respectively made in said perforated board and said comber board. In that case, the effort transmission elements are advantageously semi-rigid rods adapted to slide in sheaths whose ends are respectively immobilized in or in the vicinity of the afore-mentioned openings.

The invention also relates to a weaving loom equipped with a shed forming device such as described hereinbefore. This loom is simpler to use and maintain than the looms of the prior art.

The invention will be more readily understood on reading the following description of two forms of embodiment of a shed forming device and loom in accordance with its principle, given solely by way of example and made with reference to the accompanying drawings, in which.

Figure 1:
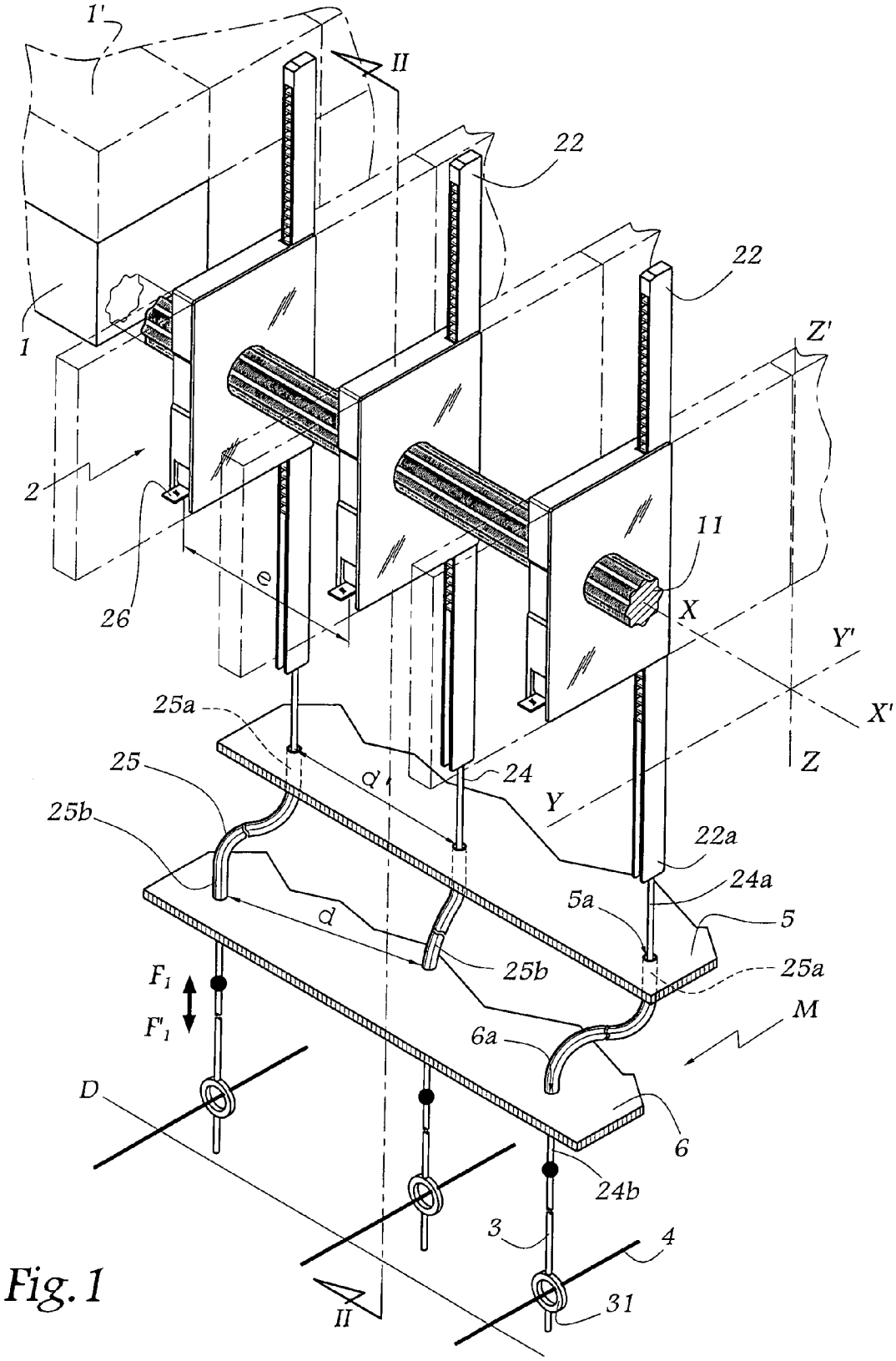
FIG. 1 is a schematic view in perspective of part of a shed forming device in accordance with a first form of embodiment of the invention.

The electrical rotary actuator 1 shown in FIG. 1 is a servo-motor provided with a splined output shaft 11 of which X–X' denotes the longitudinal geometric axis. This axis is parallel to the direction D of the weft yarns of the weaving loom.

In the vicinity of the actuator 1 there are disposed other actuators 1' of the same type which are shown in dashed and dotted lines in FIG. 1 and of which the output shafts (not shown) are parallel to shaft 11.

On the shaft 11 are mounted a plurality of identical modules 2 which each comprise a pinion 21 disposed around the shaft 11 and provided with a central opening allowing it to cooperate with the splines of this shaft in order to be driven in rotation about axis X–X'. The modules 2 may slide with reduced clearance on the corresponding shaft 11. Each module 2 also comprises a rectilinear rack 22 substantially parallel to an axis Z–Z' inclined with respect to the horizontal when the loom M is in normal configuration of use.

Each module 2 also comprises a unitary casing 23 in which the pinion 21 is mounted to rotate freely, while the rack 22 may slide, in its longitudinal direction, in a groove 43, made between a module 2 and an adjacent module 2', and obturated by a finishing plate 44.

e denotes the distance along axis X–X' between two adjacent modules 2 mounted on the shaft 11. FIG. 1 shows that this distance is not necessarily constant. In addition, taking into account the geometry of the shaft 11 which is splined over the whole of its length, the modules 2 may be displaced parallel to axis X–X', which makes it possible to vary the values of the distance e. It will also be understood that it is possible to add or to eliminate modules 2 on or from the shaft 11.

At the level of its lower end 22*a*, each rack 22 is fast with the upper end 24*a* of a rod 24 made of epoxy carbon. The elements 22 and 24 may be glued or welded together, or fixed by any other appropriate means. The rod 24 is a semi-rigid element whose lower end 24*b* is fixed to a heddle 3 provided with a mail 31 for passage of a warp yarn 4.

The rod 24 is adapted to exert, on the heddle 3 associated therewith, an upward effort of traction $F_1$ and a downward effort of thrust $F'_1$, with the result that the heddle 3 is controlled positively by the rod 24 without the need to use a return spring.

The rod 24 may be made of other materials compatible with its function. For example, it may be made of reinforced plastics material, steel or glass fibers.

Figure 5:
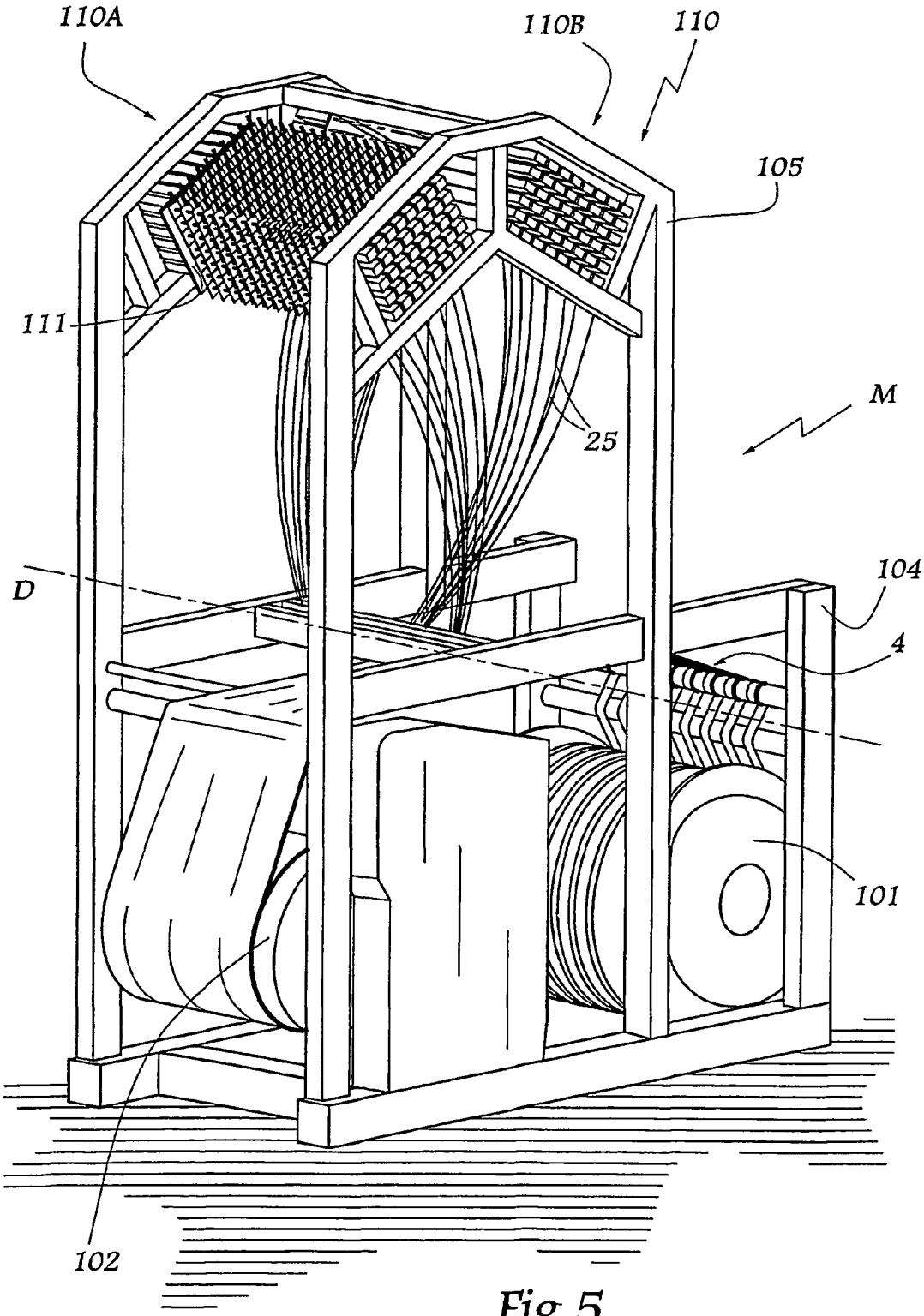
FIG. 5 is a schematic view in perspective of a loom according to the invention, incorporating the device of FIGS. 1 to 4.

The loom M shown in FIG. 5 comprises a beam 101 and a reel 102 between which the warp yarns 4 of the loom circulate.

D denotes the direction of the picks on the loom M, i.e. the direction of the weft yarns.

The loom M also comprises a chassis 104 supporting the elements 101 and 102 and a system (not shown) for passage of the picks.

The chassis 104 extends in a superstructure 105 disposed above the principal part of the loom M and supporting a shed forming device 110 and the perforated board 5.

This device is distributed in two units 110A and 110B mounted independently on the superstructure 105.

Figure 6:
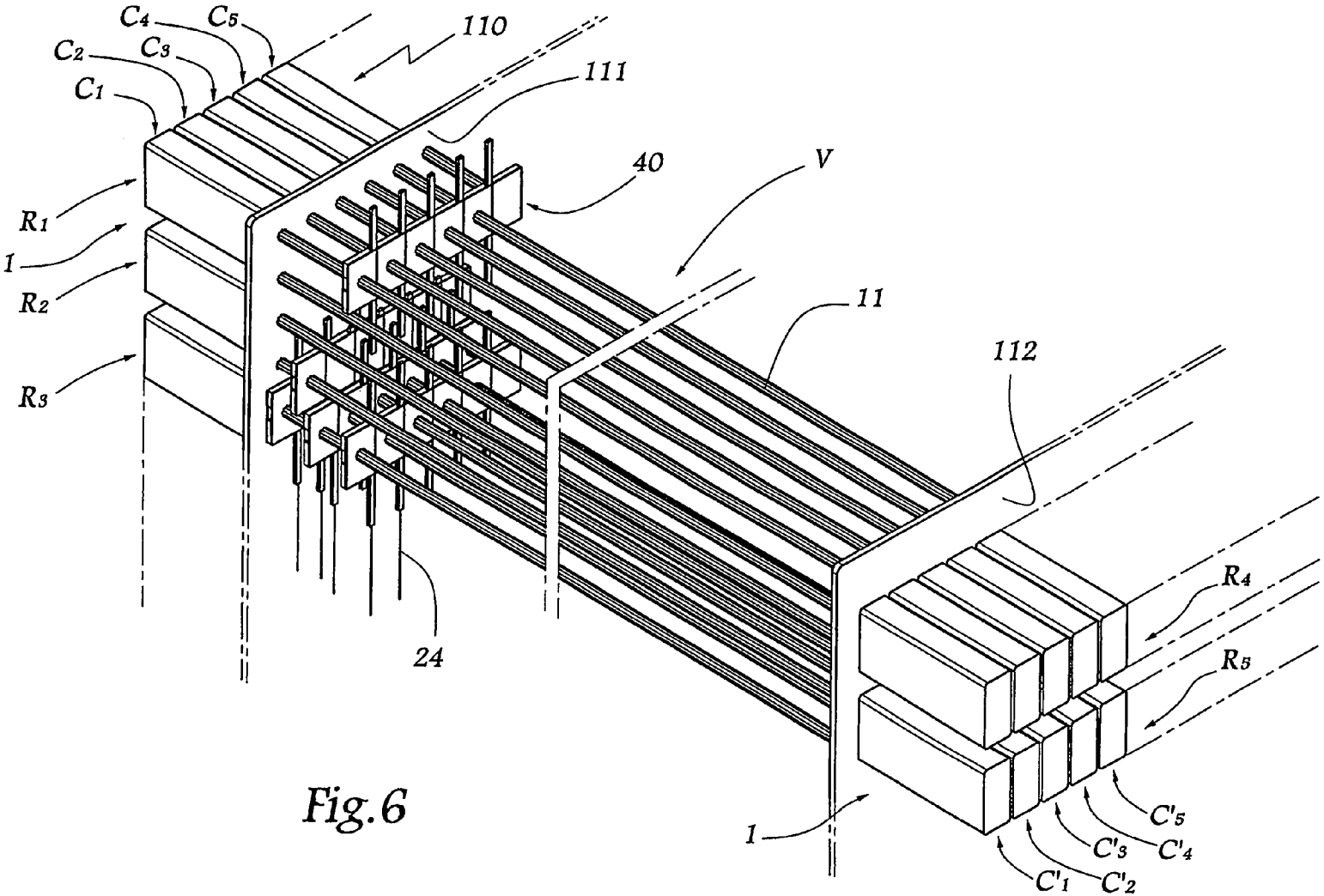
FIG. 6 is a view in perspective of a part of the loom of FIG. 5.

The unit 110A is shown partially in FIG. 6. It comprises two plates 111 and 112 between which is defined a volume V. On each plate 111 or 112 there are mounted electrical rotary actuators 1 whose output shafts 11 extend, through the plate 111 or 112, in the volume V. For greater clarity of the drawing, only a part of the shafts 11 appears in FIG. 6.

The plates 111 and 112 and the actuators 1 are arranged in the superstructure 105 in such a manner that the shafts 11, which are parallel to one another, are also substantially parallel to the direction D of the picks.

The actuators 1 are arranged in rows and in columns on plates 111 and 112.

In the example shown, the plate 111 supports six rows of eight actuators 1 which form eight columns. The plate 112 bears five rows of actuators likewise forming eight columns.

In FIG. 6, only a part of the device has been shown and three rows $R_1$ to $R_3$ can be identified, of which five actuators are visible and form five columns $C_1$ to $C_5$ on the plate 111, while two rows $R_4$ and $R_5$ of actuators forming five columns $C'_1$ to $C'_5$ are visible on plate 112.

The axis X–X' is parallel to the direction D and perpendicular to an axis Y–Y' along which rows $R_1$ to $R_5$ extend and to an axis Z–Z' along which columns $C_1$ to $C_5$ and $C'_1$ to $C'_5$ extend.

In FIG. 5, only a few sheaths 25 have been shown between the units 110A and 110B, on the one hand, and the proximity of the zone of passage of the picks, on the other hand. This aims at simplifying the drawing. In practice, numerous sheaths 25 are used in place of a conventional harness and Jacquard loom.

Figure 4:
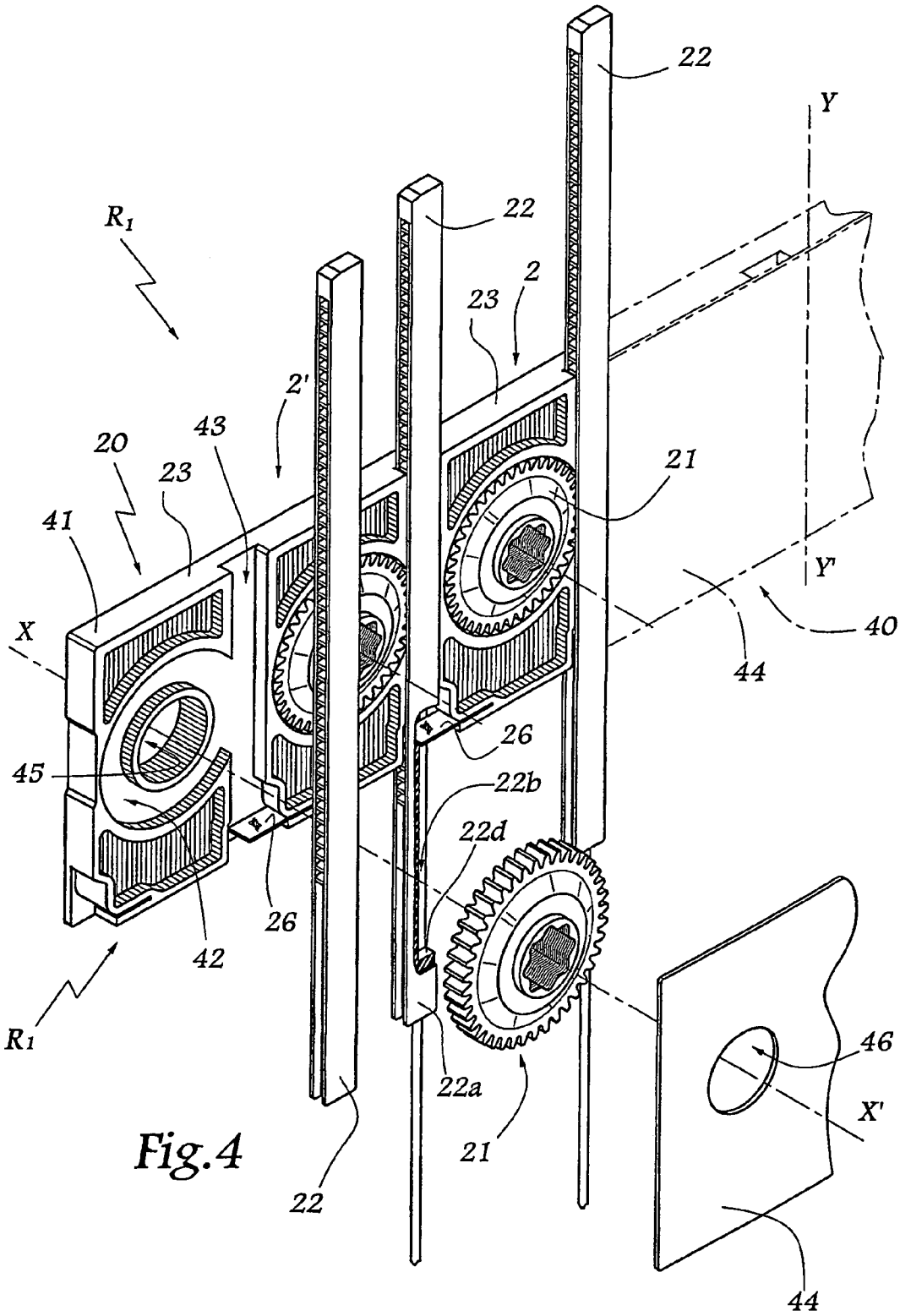
FIG. 4 is a view in perspective of a part of the device of FIGS. 1 and 2 incorporating a plurality of modules such as that of FIG. 3.

The different modules 2 intended to cooperate with the shafts 11 of the actuators 1 of row $R_1$ are integrated in a sub-assembly 40 shown in partially exploded perspective in FIG. 4. This sub-assembly 40 extends substantially in a direction parallel to axis Y–Y' and comprises eight modules 10. It is formed by a one-piece casing 41 of plastics material constituting a plurality of unitary casings 23 and in which are formed housings 42 for receiving the pinions 21 and grooves 43 for slide of the racks 22.

The closure plate 44 of the sub-assembly 40 is shown removed in FIG. 4. Openings 45 and 46 for passage of the shafts 11 are respectively provided in the casing 41 and in the plate 44.

In this way, the eight modules 20 intended to be driven by the actuators of row $R_1$ may be positioned on the corresponding shafts 11, in groups, by manipulating the sub-assembly 40. Positioning along the axis X–X' of these different shafts may likewise be adjusted in groups, which represents a considerable saving of time when constructing the device 10.

In FIG. 6, only a few sub-assemblies 40 have been shown in order to render the drawing clearer. Similarly, certain shafts 11 have been omitted for clarity of the drawing. However, it will be understood that a large number of such sub-assemblies may be provided between the plates 111 and 112 as a function of the weave to be made.

As is more particularly visible in FIG. 1, each rod 24 is disposed inside a guiding sheath 25 which extends between a perforated board 5 and a comber board 6 respectively provided with orifices 5*a* and 6*a* for receiving and immobilizing the upper (25*a*) and lower (25*b*) ends of the sheaths 25. The geometry of the sheaths 25 between the board 5 and the board 6 is variable and adapted to the desired weave. In particular, the distance d between two lower ends 25*b* of sheath 25, at the level of the board 6, is not necessarily equal to the distance d' between two upper ends 25*a* of sheath 25, at the level of the board 5, this distance d' itself being substantially equal to the distance e between the modules 2 on the shaft 11. In effect, it is possible to cause the rods 24 to follow different paths by shaping the sheaths 25 differently. The sheaths 25 corresponding to rods controlled by the same shaft 11 are preferably, but not necessarily, aligned at the level of the board 6, as is seen in FIG. 1.

In practice, the ends 25*a* and 25*b* of the sheaths 25 are immobilized in the vicinity of the orifices 5*a* and 6*a*, the sheaths 25 being able to project above the board 5 and below the board 6.

A considerable versatility is therefore offered to the user of the loom and, by playing on the distribution of the sheaths 25 in space, various weaves can be obtained with a particularly compact loom.

In each casing 23 there is provided a housing 23*a* for receiving a first end 26*a* of an elastic tongue 26 whose second end 26*b* is free with respect to the casing 23. This end 26*b* is intended to be engaged in a longitudinal groove 22*b* of a rack 22 of an adjacent module 2. The groove 22*b* extends towards the rack 22 opposite its toothing 22*c*.

In this way, the end 26*b* of the tongue 26 may slide in the groove 22*b*. In addition, the tongue 26 may come into abutment against a stop 22*d* provided in the lower part of the groove 22*b*, as shown in the left-hand side of FIG. 2. In that case, the rack 22 is in top dead centre position, in the same way as the rod 24 and the heddle 3 associated therewith.

Figure 2:
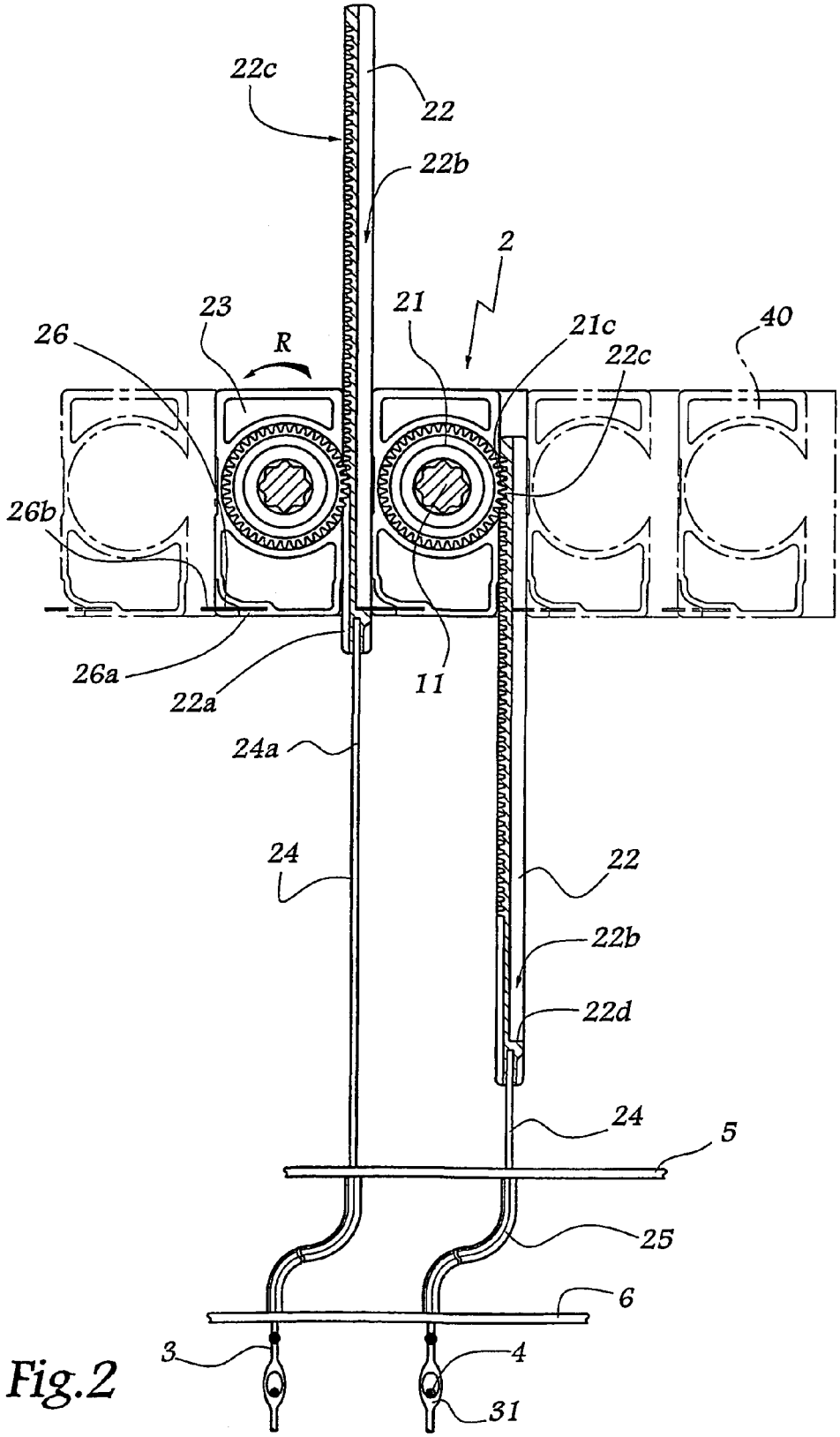
FIG. 2 is a section along line II—II in FIG. 1.
Figure 3:
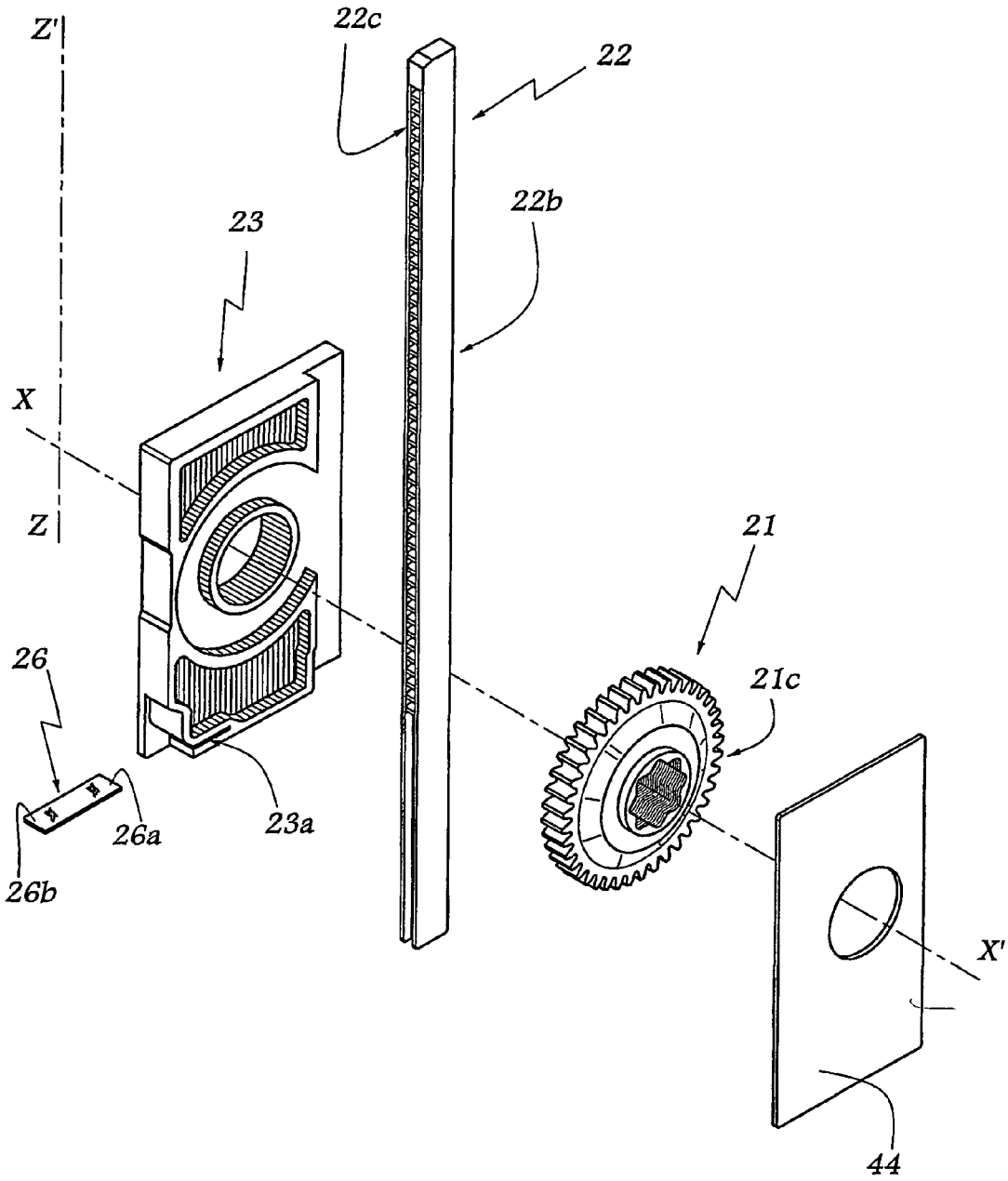
FIG. 3 is an exploded perspective view of a module of the device of FIGS. 1 and 2.

If the actuator controlling the shaft 11 shown on the left of FIG. 2 transmits to the pinion 21 an effort of rotation R in the trigonometric sense in this Figure, the tongue 26 opposes an additional upward movement of the rack 22 and the toothing 21*c* of the pinion 21 escapes from the toothing 22*c*, the tongue 26 tending to permanently return toothing 22*c* into mesh with toothing 21*c*.

This construction makes it possible to adjust at the same time the top dead centres of the different racks 22 driven by the same actuator 1, insofar as it suffices to cause the corresponding shaft 11 to rotate until all the toothings 22*c* of the racks escape the toothings 21*c* of the pinions, while the racks are in abutment against the elastic tongues associated therewith.

In a variant, this tongue might be provided to cooperate with a stop (not shown) arranged in the vicinity of the upper part of the groove 22*b*, this allowing the adjustment of the bottom dead centre of the stroke of the racks.

Figure 7:
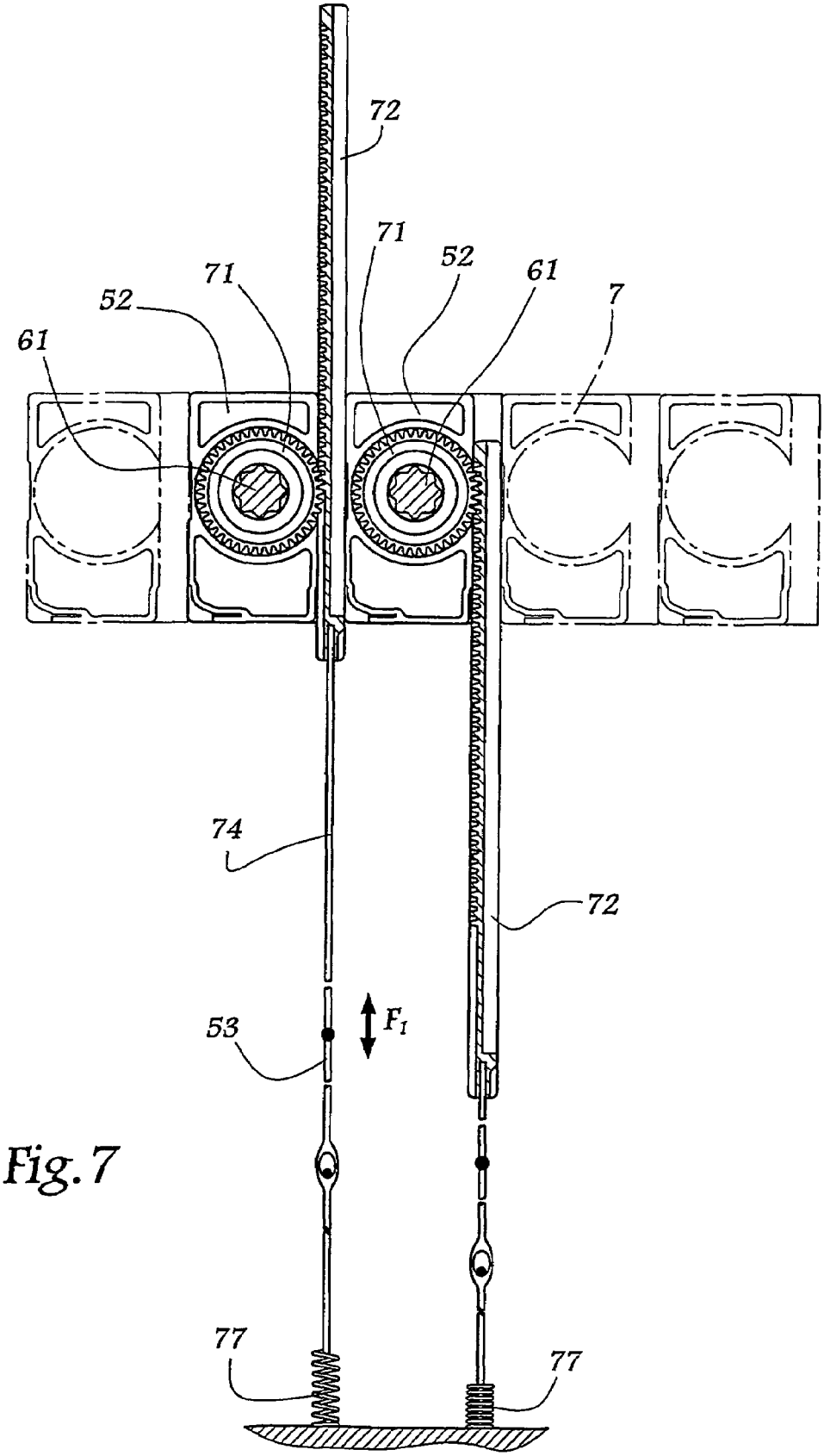
FIG. 7 is a view similar to FIG. 2, for a device in accordance with a second form of embodiment of the invention.

In the second form of embodiment of the invention shown in FIG. 7, elements similar to those of the first form of embodiment bear identical references increased by 50. In this embodiment, the modules 52 comprise pinions 71 associated with racks 72 connected to harness cords 74 for controlling the heddles 53. The harness cords 74 make it possible to exert an upward effort of traction $F_1$ on the heddles 53, while the return springs 77 enable a downwardly directed effort to be exerted on these heddles.

The springs 77 can allow a synchronisation of the different racks driven by the same shaft 61, by performing a role similar to that of the tongues of the first embodiment.

This second embodiment presents the particular advantage of being usable with a conventional Jacquard harness, a known perforated board and comber board.

The invention has been represented with each effort transmission element 24 or 74 connected to a single heddle 3 or 53. However, it is possible to control a plurality of heddles with such an element.

The invention has been shown with the shafts 11 and 61 of the actuators 1 substantially parallel to direction D of the weft yarns. This is not obligatory, as it is possible to make use of the flexible nature of the effort transmission means 24 and 74.

Whenever reference is made to an output shaft, this is understood to mean any shaft driven by an actuator, whether it be in direct engagement therewith or through a reduction gear. The output shaft may be aligned or non-aligned with the geometric axis of the rotating part of the actuator, the possible reduction gear being able to perform the role of a bevel gear.

The invention has been represented with pinions added on the output shafts of the actuators. It is also applicable with an actuator provided with an output shaft whose transverse section is such that it may engage directly with one or more racks, this shaft itself thus constituting one or more pinions within the meaning of the present invention. In other words, in the case of such a shaft meshing with a plurality of racks, it forms a succession of pinions attached to one another.

The invention has been represented with actuators arranged above the heddles and the shed. However, it is applicable to the case of the actuators being placed below the heddles and the shed, which facilitates access to the shed and reduces space requirement.

The invention claimed is:

1. Device for forming the shed in a weaving loom of Jacquard type, said device comprising at least one electric rotary actuator, characterized in that said actuator (1) is adapted to drive in rotation (R) at least one pinion (21; 71) in mesh with a rack (22; 72) connected by an effort transmission element (24; 74) to at least one heddle (3; 53).

2. Device according to claim 1, characterized in that said actuator is adapted to drive in rotation a plurality of racks (22; 72) distributed along the longitudinal direction (X–X') of an output shaft (11; 61) of said actuator (1).

3. Device according to claim 2, characterized in that the distance (e) between said racks (21; 71) in said direction (X–X') and/or the number of racks driven by said actuator (1) are adjustable.

4. Device according to one of claim 2, characterized in that the drive pinions (21; 71) of said racks (22; 72) are adapted to slide with reduced clearance along the longitudinal direction (X–X') of said shaft (11; 61), and in that said shaft and said pinions present complementary profiles, splined or equivalent.

5. Device according to one of claim 2, characterized in that it comprises means for synchronising the racks (22; 72) in mesh with the pinions (21; 71) driven by the same actuator (1), said synchronising means comprising an elastic element (26; 77) adapted to limit the stroke of the rack to a position beyond which its toothing (22*c*) would be disconnected from the toothing (21*c*) of the pinion associated therewith.

6. Device according to claim 5, characterized in that said elastic element (26) is provided with an end (26*b*) adapted to abut against a stop (22*d*) formed on the corresponding rack (22).

7. Device according to claim 6, characterized in that said rack (22) is provided with a longitudinal groove (22*b*) for receiving said second end (26*b*) of said element (26) and slide thereof.

8. Device according to claim 1, characterized in that said effort transmission element is a semi-rigid rod (24).

9. Device according to claim 8, characterized in that said rod (24) is adapted to slide in a guiding sheath (25).

10. Device according to claim 9, characterized in that said rod (24) is made of synthetic material, based on epoxy carbon.

11. Device according to claim 1, characterized in that said effort transmission element is a supple funicular element (74), of harness cord type.

12. Device according to claim 1, characterized in that it comprises electrical rotary actuators arranged in rows and/or in columns above the loom, in that said actuators (1) are disposed so that their respective output shafts (11) are substantially parallel to one another, preferably substantially parallel to the direction (D) of the weft yarns of the loom (M), and in that each output shaft is adapted to drive a plurality of pinions (21) each in mesh with a rack (22) kinematically connected to at least one heddle (3) for controlling a warp yarn (4).

13. Device according to claim 12, characterized in that said actuators (11) are distributed on plates (111, 112) immobilized with respect to the superstructure (105) of the loom (M) and arranged substantially parallel to the warp yarns (4).

14. Device according to claim 13, characterized in that said actuators (1) are distributed in two groups ($R_1$–$R_3$, $R_4$–$R_5$) each supported by a plate (111, 112), the output shafts (11) of said actuators extending, in essence, in a volume (V) defined between said plates.

15. Device according to claim 14, characterized in that a plurality of pinions (15) driven by parallel and distinct shafts (11) are integrated, with the corresponding racks (22), in a sub-assembly (40) extending substantially in a direction (Y–Y') perpendicular to said shafts.

16. Device according to claim 15, characterized in that said sub-assembly (40) comprises pinions (21) and racks (22) in a number corresponding to the number of actuators of a row ($R_1$–$R_5$).

17. Device according to claim 16, characterized in that each sub-assembly (40) comprises a common casing (41) provided with openings (45) for passage of said shafts (11) and with housings (42, 43) for receiving said pinions (21) and said racks (22).

18. Device according to claim 12, characterized in that it comprises a perforated board (5) immobilized with respect to the superstructure (105) of the loom (M), in the proximity of said actuators (1), and a comber board (6) disposed in the proximity of the heddles (3), and in that said elements (24; 74) for transmitting effort between said racks (22; 72) and the heddles (3) associated therewith each follow a path defined by openings (5*a*, 6*a*) made respectively in said two boards.

19. Device according to claim 18, characterized in that said actuator (1) is arranged below said heddles (3; 53) and below the shed (4).

20. Device according to claim 1, characterized in that said pinion is formed by the output shaft of said actuator or a part of said shaft.

21. Weaving loom (M), characterized in that it comprises a shed forming device (1–7; 52–77) according to claim 1.

* * * * *